United States Patent [19]

Karle et al.

[11] 4,142,690

[45] Mar. 6, 1979

[54] SPOOL CARRIER, PARTICULARLY FOR WINDING UP TEXTILE THREADS OR THE LIKE

[75] Inventors: Herbert Karle, Rheinstetten; Gunter Jahrig, Eggenstein-Leopoldshafen, both of Fed. Rep. of Germany

[73] Assignee: Industrie-Werke Karlsruhe Augsburg Aktiengesellschaft, Fed. Rep. of Germany

[21] Appl. No.: 834,899

[22] Filed: Sep. 20, 1977

Related U.S. Application Data

[63] Continuation of Ser. No. 676,670, Apr. 14, 1976, abandoned.

[30] Foreign Application Priority Data

Apr. 18, 1975 [DE] Fed. Rep. of Germany ..... 7512509

[51] Int. Cl.[2] ..... B65H 54/54; B65H 75/30

[52] U.S. Cl. ..... 242/46.4; 242/46.6; 242/72.1

[58] Field of Search ..... 242/46.4, 46.2, 46.3, 242/46.5, 46.6, 72.1

[56] References Cited

U.S. PATENT DOCUMENTS

| | | | |
|---|---|---|---|
| 2,746,689 | 5/1956 | Berkepeis | 242/46.3 |
| 3,052,420 | 9/1962 | Roberts | 242/46.3 |
| 3,092,342 | 6/1963 | Jackson | 242/46.2 |
| 3,384,315 | 5/1968 | Heumann | 242/46.6 |
| 3,526,369 | 9/1970 | Beckwith, Jr. | 242/46.4 |
| 3,593,934 | 7/1971 | Conrad et al. | 242/46.5 |
| 3,596,845 | 8/1971 | Rajnoha et al. | 242/46.5 |
| 3,779,472 | 12/1973 | Boggs | 242/46.4 X |
| 3,833,179 | 9/1974 | Maurer | 242/46.4 |

*Primary Examiner*—Stanley N. Gilreath
*Attorney, Agent, or Firm*—McGlew and Tuttle

[57] ABSTRACT

A spool carrier, particularly for winding up textile threads and for centering and clamping spools which are made up of deformable material such as a paperboard or stiff multilayer paper comprises at least one two-member group having first and second members which have interengageable wedge-shaped portions, which are mounted on a spool carrier one after the other in an axial direction. The two members are urged into wedging interengagement by a biasing spring so that the outer member is displaced outwardly into engagement with the spool carrier. A coupling rod mounted for axial displacement within the spool carrier is movable against the biasing means to disengage the first and second members so as to release the spool.

6 Claims, 6 Drawing Figures

SPOOL CARRIER, PARTICULARLY FOR WINDING UP TEXTILE THREADS OR THE LIKE

This is a continuation of application Ser. No. 676,670 filed Apr. 14, 1976 now abandoned.

FIELD AND BACKGROUND OF THE INVENTION

This invention relates in general to the construction of spool carriers and in particular to a new and useful spool carrier having means for readily engaging and disengaging a spool.

DESCRIPTION OF THE PRIOR ART

After textile threads are produced, they must be wound up for further treatment or processing. For this purpose it is general practice to use relatively large spools of massive structure which are slipped over spool carriers and centered thereon and clamped. Particularly because of the high speed of operation of the order of up to 12,000 revolutions per minute at which the spools rotate, the spool carriers commonly used for centering and clamping such spools have a rather massive and consequently also a voluminous structure so as to be capable of accommodating all of the necessary centering and clamping elements for a whole group of spools. The massiveness of the spool carriers becomes particularly conspicuous in cases where a plurality of spools is to be received on a spool carrier one after the other in an axial direction. The results of such arrangements is that the significant weight of the spool carriers and their overall length and the relatively large spools with large hub diameters becomes far greater than a relatively small amount of material which is to be received on the spools. The development in the textile technology, however, which tends particularly toward the so-called "single way spool" requires light weight and relatively thin spools which have a small hub diameter and are made of paperboard or stiff multilayer paper. For this reason the known spool carrier constructions are not suitable.

During the winding up of particularly synthetic threads, high pressures are produced which act on the spool in a radial direction. Primarily with partly drafted threads, the internal shrinkage strain within the wound package causes a compression of the spool so that the internal diameter of the spool becomes reduced. The use of such spools on conventional spool carriers results in quite considerable difficulties with the clamping and unclamping mechanisms as well as the removal of the spool packages after they have been wound. Not infrequently, the forces acting on the spool and thereby also on the spool carrier cause a jamming of the clamping mechanism of the spool carrier so that a great effort is necessary to eliminate this difficulty. Such an effort is undesirable and technologically not justifiable, and also the life of the spool carrier is considerably reduced.

SUMMARY OF THE INVENTION

In view of the drawbacks mentioned above, the present invention provides a spool carrier of relatively simple construction, with which a centric clamping of the spool is ensured, and which is capable of absorbing the shrinkage of the spool occurring during the winding operation without any jamming of the spool or the package on the spool carrier. The high radial forces are thereby reduced also. No difficulties arise with the unclamping and there are still fewer difficulties with the removal of the spool. Furthermore the present invention contributes to a development towards the single way spool.

In accordance with the invention, at least one set of two member groups are mounted on a carrier tube and each group includes an external member having an interior wedging surface wedgingly engageable with a similar wedging surface of an internal member. The two members are biased by a spring in a direction to cause their wedging interengagement and the outward resilient stretching or movement of the outer member to engage against the interior of a spool. Disengagement is effected by movement of a coupling rod axially within the carrier tube to cause a pin of the rod to move the innermost member out of wedging interengagement with the outermost member and release the spool. Under the biasing force of the spring one member of each group is expanded outwardly and fixes the spool to the carrier, while the displacement of the coupling rod in the opposite axial direction releases the spool from the carrier.

According to an advantageous development of the invention each member group comprises two bodies of revolution which are conformable to and axially engageable with each other and which complement each other in respect to the wedge-like surfaces of revolution which are in engagement. Preferably the internal body of revolution of each member group is mounted for longitudinal displacement on a carrier tube which also serves for receiving the coupling rod.

Particular attention is directed to the design of the wedge-like bearing surface of the internal body of revolution, which, according to another feature of the invention, is substantially smaller than the axial overall length of the wedging surface of revolution of the other member. The external member is provided on its outer periphery advantageously with a plurality of slots which are distributed around its periphery and impart a natural elasticity to the member so that it may expand outwardly into engagement with the spool. This member is also advantageously formed with a reduced diameter portion intermediate of two increased diameter portions at respective ends of the body. In this manner the end portions are only applied against the spool.

According to still a further feature of the invention a coupling rod is provided with pins or bolts or similar projections which project from the rod at a right angle relative to the direction of displacement of the rod and which are guided in slots of the coupling tube. These pins engage against the innermost one of the members of each set and displace it out of wedging engagement against the biasing force of the spring. Each body may be designed as a member having an outer diameter which is reduced in length so that a plurality of axially spaced short contact surfaces for the spool is formed. The outer member may have a plurality of axially spaced contact surfaces with released areas or other elements which aid in their resilient character.

Accordingly it is an object of the invention to provide an improved spool carrier, particularly for winding up textile threads and for centering and clamping spools which are made of deformable material, and which comprise at least one two-member group, each including first and second members which have interengageable wedge-shaped portions, and which are mounted on a spool carrier, one after the other in an axial direction, which are biased by biasing means into wedging interengagement so as to displace the outermost member into engagement with the spool, and which also includes a displaceable coupling rod movable in the carrier against the biasing force to disengage the members and the spool.

A further object of the invention is to provide a spool carrier which is simple in design, rugged in construction and economical to manufacture.

For an understanding for the principles of the invention, reference is made to the following description of typical embodiments thereof as illustrated in the accompanying drawings.

GENERAL DESCRIPTION OF THE PREFERRED EMBODIMENTS

Figure 1:
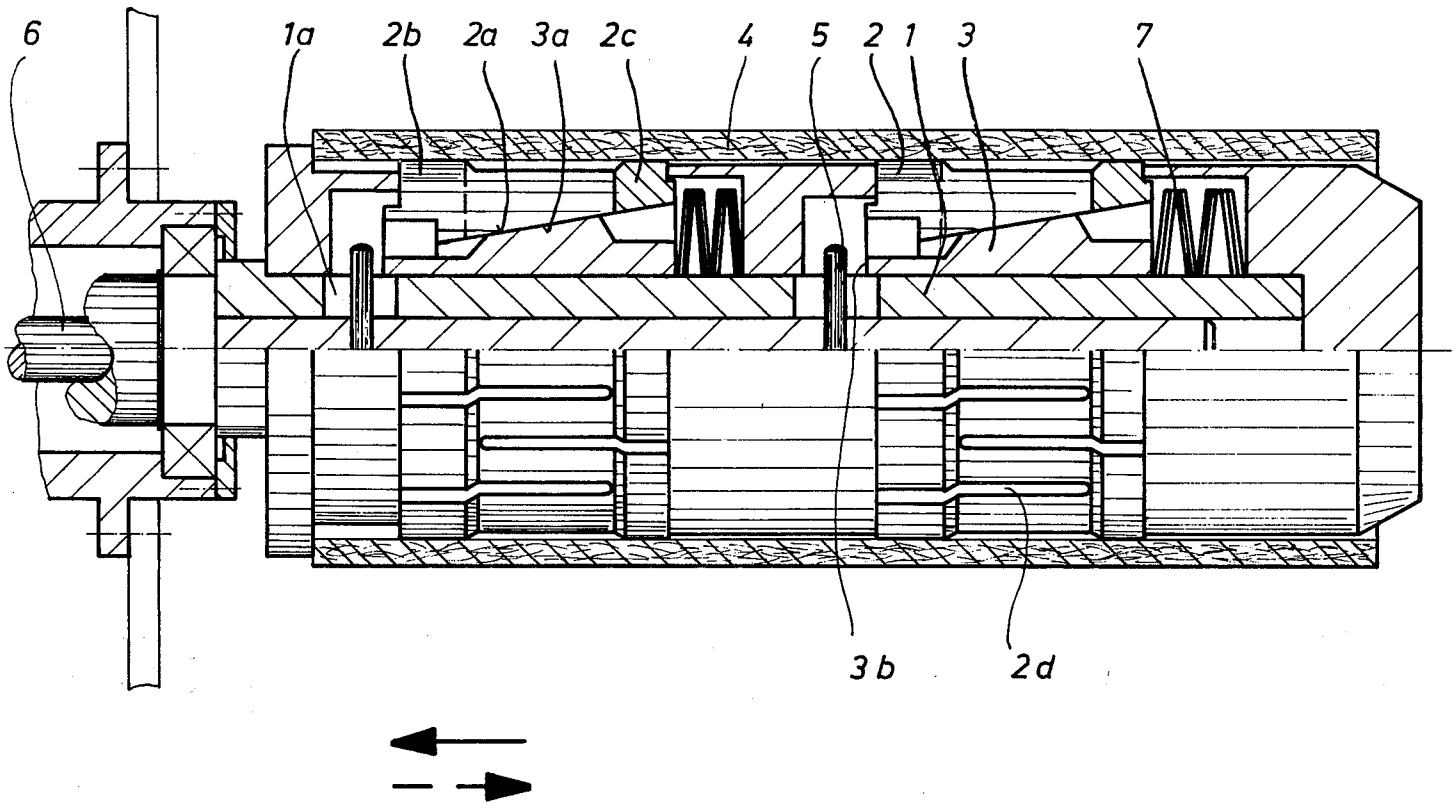
FIG. 1 is a partial vertical sectional view of a spool carrier constructed in accordance with the invention.

Referring to the drawings in particular, the invention embodied therein in FIG. 1 comprises a spool carrier which includes a plurality of two-member groups which operate on a wedge principle and which comprises an outer tubular member 2 and an inner member 3 which are mounted on a coupling tube 1. Each group outer member 2 has an interior wedge-like bearing surface of revolution 2*a* and each inner member includes an exterior wedge-like bearing surface of revolution 3*a* complementary to the surface 2*a*. In order to reduce the contact surface areas for a spool 4, the outer diameter of the external member 2 is partly reduced. Consequently a spool 4 applies against the outer member 2 only along portions or bearing segments 2*b* and 2*c* thereof. The wedge-like bearing surface or conical surface 3*a* of their inner member 3 is reduced to an extension corresponding to the length of the reduced diameter portion of the external member 2.

It is to be noted that wedging member 2, defined as the outer member comprises an annular member having an inner tapering surface 2*a* and an outer cylindrical surface having raised end portions 2*b* and 2*c* with a reduced intermediate portion which is not referenced. Also, as is clearly shown in FIG. 1, the outer member is provided with a series of circumferentially spaced slots 2*d* wherein the slots alternately extend inwardly from the opposed ends of the outer member.

The coupling tube 1 is provided with a plurality of oblong slots 1*a* at spaced locations along its length in alignment with the respective ends of each of the member groups. An axially displaceable coupling rod 6 is received within the tube 1, and it is provided with axially spaced radially extending pins 5 which engage through the slots 1*a*. Biasing means in the form of cup springs 7 are arranged around the tube 1 and may act upon the outer and inner members 2 and 3 to urge them into wedging engagement and to cause a displacement or a circumferential expansion of the outer member 2 into engagement with the spool 4. The coupling rod 6 is movable in the direction indicated by the solid line arrow to move the pins axially away from the members 2 and 3 and permit their wedging interengagement.

If after the finished winding operation the spool 4 along with the wound package which is not shown is to be removed from the spool carrier, the coupling rod 6 is displaced in the opposite direction indicated by the broken line arrow to displace the pin 5 along the slot 1*a* so as to engage one end of the member 3 and displace it out of wedging engagement with the member 2 by moving it against the biasing force of the spring 7. This causes the outer diameter of the external member 2 to become slightly reduced and to cause it to disengage from the spool 4. This diameter reduction is made so as to permit easy disengagement from the spool. In order to improve the elastic behavior of the outer member 2 the outer surfaces of this member are provided with slots 2*d* which are distributed over the circumference in spaced relationship and extend substantially in the axial direction alternately from the respective ends of the member 2. The longitudinal slots 2*d* favor deflection of the bodies of revolution 2 in the zone of the bearing surfaces 3*a* of the inner member 3.

Figure 3:
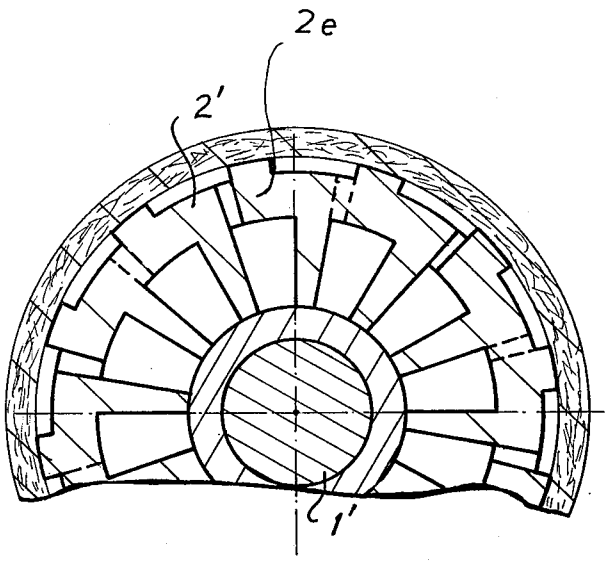
FIG. 3 is a transverse sectional view of FIG. 2 taken along line III—III.
Figure 2:
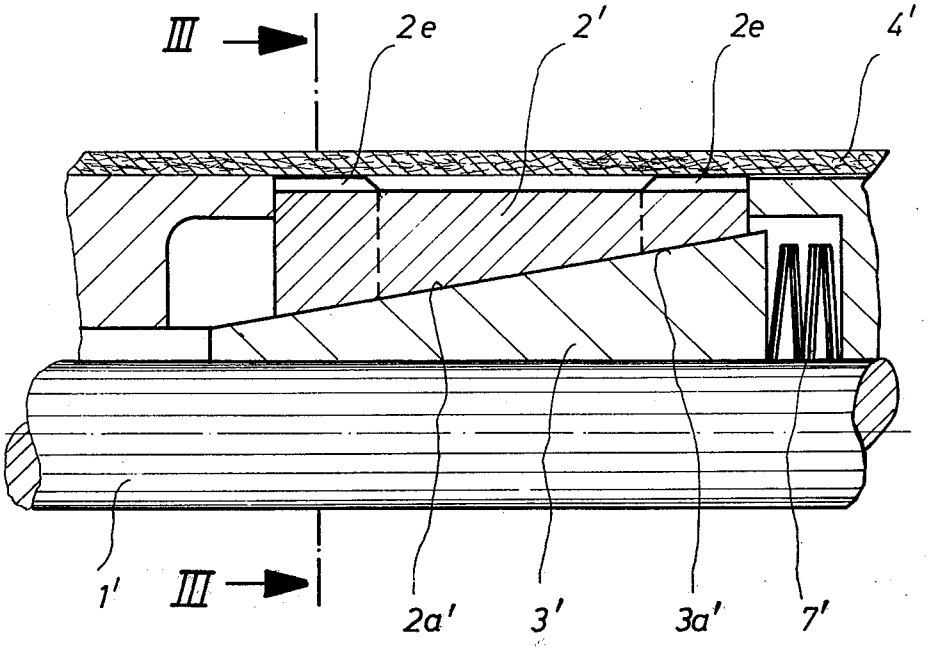
FIG. 2 is a view similar to FIG. 1 of another embodiment of the invention.
Figure 5:
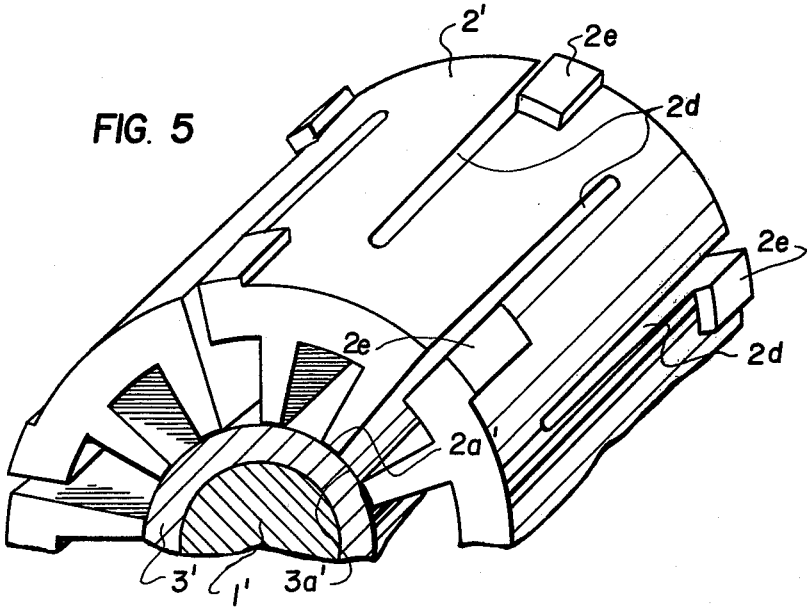
FIG. 5 is a perspective rendition of the embodiment disclosed in FIGS. 2 and 3.

In the embodiment of FIGS. 2, 3 and 5 parts similar to that shown in FIG. 1 are designated with the same number but with the addition of a prime. This construction differs from FIG. 1 in respect to the construction of the outer member 2', which is provided with segmental surface areas 2*e* which are circumferentially spaced from each other.

It will be noted that the outer wedging member comprises essentially an annular member having specifically constructed portions such as for example 2*e* of FIG. 2 and 2*b* and 2*c* of FIG. 1 which engage the spool 4 when the outer member is radially extended. The alternating slots 2*d* provide for radial expansion and compression of the annular member in a uniform manner. Thus, the annular member of the wedging means is constructed so that it can be radially expanded and compressed in a uniform manner which facilitates the release of the spool from the spool chuck.

Figure 4:
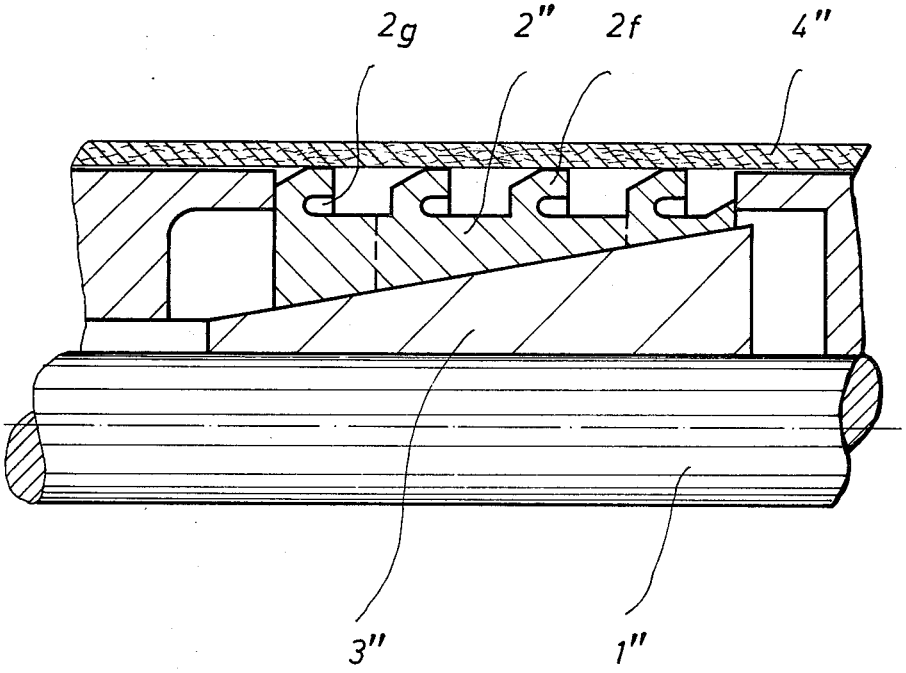
FIG. 4 is a view similar to FIG. 1 of still another embodiment of the invention.
Figure 6:
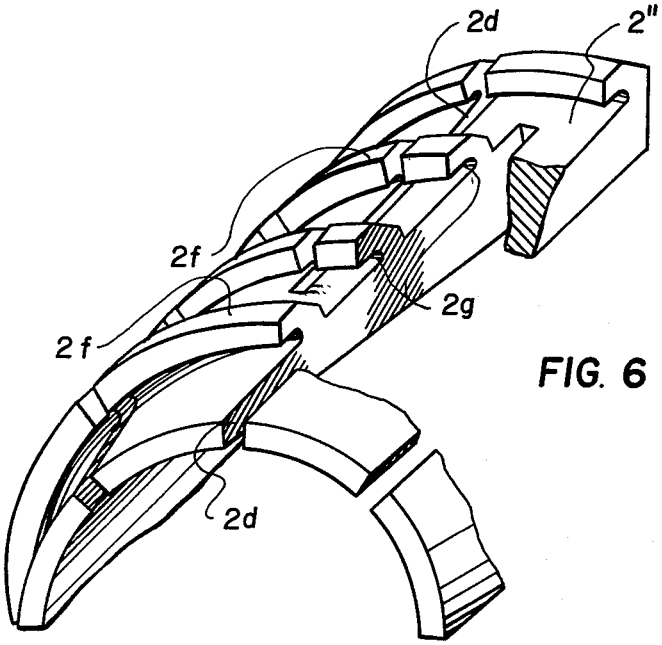
FIG. 6 is a perspective view of the embodiments disclosed in FIG. 4.

In the embodiment of FIGS. 4 and 6 the outer member 2'' is provided with segmental surface areas 2*f* which are spaced circumferentially and axially, that is, they are located one after the other along the body. In this construction a backoff or release recess or the like 2*g* may be provided beneath the segmental areas for increasing the elasticity.

While specific embodiments of the invention have been shown and described in detail to illustrate the application of the principles of the invention, it will be understood that the invention may be embodied otherwise without departing from such principles.

What is claimed is:

1. A spool chuck for winding textile threads and for centering and clamping spools therefor made of a deformable material such as paperboard, multi-layer paper, etc. comprising a coupling tube, a plurality of complementary wedging means axially spaced along said coupling tube whereby said wedging means are operative to engage and disengage a spool, each of said wedging means including an outer member and an inner member, said outer and inner members of each of said wedging means being axially movable relative to one another along said coupling tube, each of said outer members being of an annular configuration having an outer surface with a reduced diameter area intermediate the ends thereof, leaving a spool bearing raised portion at either end thereof, and having a tapered inner surface, and each of said inner members being an annular member having a tapered outer surface complementing the tapered inner surface of its respective outer member, said outer tapered surface of each of said inner members being co-extensive in axial length to the axial length of the reduced diameter area of its respective outer member to provide radial resiliency to said outer members in the area of said spool bearing portions, spring means normally biasing said outer and inner members of each of said wedging means toward a spool engaging position, in which each of said spool bearing portions bears normally against a spool with substantially equal force, said outer member of each of said wedging means having a series of longitudinally extending circumferentially spaced slots to render each of said outer members radially compressive, the longitudinal slots extending inwardly from the opposed ends of said outer member in an alternate arrangement, a coupling rod extending longitudinally of said coupling tube, and means annealed to said rod and arranged to engage the inner member of each of said wedging means, said rod and annealed means displaceable in a direction opposite to the bias of said spring means operating on said wedging means to effect relative displacement of said inner and outer members to effect the release of a spool mounted on said chuck.

2. A spool chuck for winding textile threads and for centering and clamping spools therefor made of a deformable material, such as paperboard, multi-layer paper, etc. comprising a coupling tube, a plurality of complementary wedging means axially spaced along said coupling tube whereby said wedging means are operable to engage and disengage a spool, each of said wedging means including an outer member and an inner member, said outer and inner members of each of said wedging means being axially movable relative to one another along said coupling tube, each of said outer members being of an annular configuration having an outer surface with at least one reduced diameter area intermediate the ends thereof leaving a plurality of spool bearing surface segments and a tapered inner surface, said spool bearing surface segments each having a portion undercut from said outer member for providing resilience thereto, and each of said inner members being an annular member having a tapered outer surface complementing the tapered inner surface of its respective outer member, spring means normally biasing said outer and inner members of each of said wedging means toward a spool engaging position, said outer member of each of said wedging means having a series of longitudinally extending circumferentially spaced slots to render each of said outer members radially expandable into said spool engaging position to engage said spool bearing segments with equal normal force against the spool and compressive to release the spool, said longitudinal slots extending inwardly from opposite ends of said outer member in an alternate arrangement, a coupling rod extending longitudinally of said coupling tube, and means annealed to said rod and arranged to engage the inner member of each of said wedging means, said rod and annealed means being displaceable in a direction opposite to the bias of said spring means operating on said inner and outer members to effect the release of the spool mounted on said chuck.

3. A spool chuck according to claim 2, wherein said means annealed to said coupling rod comprise a pin radially extending from said rod and slideable in a slot in said coupling tube and engageable with said inner member.

4. A spool chuck according to claim 2, wherein said spring means is a series of cup springs.

5. A spool chuck according to claim 2, wherein the outer surface of said outer member further includes a plurality of circumferentially spaced reduced diameter areas leaving a plurality of circumferentially spaced spool bearing segments for engagement with the spool.

6. A spool chuck according to claim 5, wherein said undercut portion extends circumferentially substantially under each of said spool bearing surface segments and axially across the axial width of each of said outer members.

* * * * *